US006009948A

United States Patent [19]

Flanders et al.

[11] Patent Number: 6,009,948

[45] Date of Patent: Jan. 4, 2000

[54] RESONANCE TOOLS FOR USE IN WELLBORES

[75] Inventors: Bruce A. Flanders; Gerald D. Lynde, both of Houston; Paulo S. Tubel, The Woodlands; Ray Ballantyne, Houston, all of Tex.

[73] Assignee: Baker Hughes Incorporated, Houston, Tex.

[21] Appl. No.: 08/863,249

[22] Filed: May 27, 1997

Related U.S. Application Data

[60] Provisional application No. 60/024,728, May 28, 1996, and provisional application No. 60/030,145, Oct. 30, 1996.

[51] Int. Cl.[7] ..... E21B 31/00; E21B 41/00

[52] U.S. Cl. ..... 166/301; 166/177.2; 166/177.6; 175/56

[58] Field of Search ..... 166/249, 177.1, 166/177.2, 177.6, 301; 175/56

[56] References Cited

U.S. PATENT DOCUMENTS

| | | | |
|---|---|---|---|
| 2,948,059 | 8/1960 | Bodine, Jr. . | |
| 4,236,580 | 12/1980 | Bodine | 166/301 |
| 4,384,625 | 5/1983 | Roper et al. . | |
| 4,667,742 | 5/1987 | Bodine . | |
| 4,673,037 | 6/1987 | Bodine | 166/177.2 X |
| 4,881,406 | 11/1989 | Coury . | |
| 5,370,180 | 12/1994 | Barbee . | |

FOREIGN PATENT DOCUMENTS

| | | |
|---|---|---|
| 0 245 892 | 4/1987 | European Pat. Off. . |

*Primary Examiner*—Roger Schoeppel
*Attorney, Agent, or Firm*—Madan, Mossman & Sriram, P.C.

[57] ABSTRACT

The present invention provides a system for performing a suitable operation in a wellbore utilizing a resonator. The system includes a resonator for generating pulses of mechanical energy, an engaging device for securely engaging an object in the wellbore and a sensor for detecting the response of the object to pulses generated by the resonator. The resonator is placed at a suitable location in the wellbore and the engaging device is attached to the object. The resonator is operated at an effective frequency to induce pulses into the object. The sensor detects the response of the object to the induced pulses, which information is utilized to adjust the operating frequency. The system in different configurations can be used to fish, free a stuck drill string, aid drilling of wellbores and to perform a cementing operation. A control circuit controls the operation of the system according to programmed instructions.

31 Claims, 7 Drawing Sheets

RESONANCE TOOLS FOR USE IN WELLBORES

CROSS-REFERENCE TO RELATED APPLICATIONS

This application claims the benefit of the filing dates of provisional applications Ser. No. 60/024,728, Filed May 28, 1996 and Ser. No. 60/030,135, filed Oct. 30, 1996, under 35 U.S.C. § 119(e).

BACKGROUND OF THE INVENTION

1. Field of the Invention

This invention relates generally to drilling and completing wellbores and more particularly to the use of vibratory and resonance devices downhole for performing selected drilling and completion operations for the production of hydrocarbons from subsurface formations.

2. Background of the Art

To obtain hydrocarbons such as oil and gas, boreholes or wellbores are drilled from surface locations into hydrocarbon-bearing subterranean geological strata or formations. A large amount of current drilling activity involves the drilling of highly deviated or substantially horizontal wellbores. Often, during the drilling of a wellbore, the drill bit and/or the drill pipe or tubing utilized for drilling the wellbore get stuck downhole, frequently at great distances from the wellbore mouth at the surface location. Additionally, during the completion, production and workover of the wellbores, various devices get stuck that must be retrieved from the wellbore. In many cases the stuck object must be freed and retrieved to continue to drill the wellbore or to continue to perform other operations. In many cases it is more desirable and less expensive to free (dislodge) the stuck object and either continue drilling of the wellbore or retrieve the object to the surface for repair or for substituting such object with a more suitable device than to leave the stuck object downhole. The object to be dislodged and/or retrieved is referred to in the industry as the "fish" and the process of dislodging and/or retrieving is referred to as "fishing."

A variety of fishing tools are utilized to free and retrieve stuck objects in wellbores in the oil and gas industry. A majority of these fishing tools are mechanical devices and do not include any local or downhole intelligence. Fishing tools utilizing resonance have been used for freeing stuck drill pipes and other objects in the wellbores. U.S. Pat. No. , 4,815,328, issued to Albert Bodine and assigned to the assignee of the present invention and which is incorporated herein by reference, discloses a roller-type orbiting mass oscillator for generating resonance downhole. To loosen a drill pipe stuck in a wellbore, the device is attached at a suitable place to a drill pipe and is vibrated laterally by passing a pressurized fluid therethrough. The vibration rate is controlled by controlling the fluid flow at the surface. Such a device does not provide any positive method to determine when the stuck pipe has achieved resonance, nor any method for sweeping the operating frequency range to determine the optimum operating frequency, nor method to automatically adjust operating parameters such as the fluid flow rate to at continually or least periodically operate the tool at the optimum frequency.

More recently, surface-operated and surface-controlled resonance tools have been utilized to free stuck tubulars downhole. One such surface tool is available from Baker Hughes Incorporated referred to as the Resonance Tool, Product No. 140-52. It is known that all tubulars exhibit resonant frequencies that are a function of the free length of the tubular. This resonant tool is placed at the surface (near the wellhead). It applies acoustic energy to the stuck point through a work string in order to free the tubular. This tool contains an oscillator, a hydraulic power pack and a control panel. The control panel allows for remote control operations of the resonator. Such a tool requires a great amount of power, is large in size and heavy (several thousand pounds), is relatively inefficient because of its great distance from the stuck point and is expensive to manufacture.

To make a wellbore ready for production of hydrocarbons (i.e., to complete the wellbore), a liner (which is essentially a tubular string) is inserted into the wellbore with its upper end attached to the casing (previously installed in the uphole section of the wellbore) with a device known as a liner hanger. Cement is pumped downhole to fill the space (annulus) between the liner and the wellbore. Frequently the liner is moved up and down and/or rotated during cementing operations to fill any voids or channels in the annulus and to generally improve the integrity of the cement bond between the liner and the wellbore. Even using this method, the cement in the annulus in many wellbores includes voids and channels and is not packed as desired. It is therefore, desirable to have additional and/or alternative methods to improve the integrity of the cement in the annulus.

The present invention addresses the above-noted and other deficiencies of the prior art resonance devices and provides fishing tools with a downhole resonator, wherein the response of the stuck object to the resonator-induced pulses of mechanical energy is detected by a sensor associated with the fishing tool. A resonance tool also is provided to aid in the installation of liners and other cementing operations downhole. A control unit placed at the surface or in the resonance tool determines the optimum operating frequency within a range of frequencies and operates the resonator at such determined frequency. The invention further provides different configurations of the fishing tool for different applications. Additionally, this invention provides certain devices for securing the fishing tool to drill pipes at suitable locations above the stuck point. The fishing tools of the present invention may induce both the lateral and axial vibrations into the stuck object. The present invention also provides novel devices for latching the resonance tools to tubular members.

SUMMARY OF THE INVENTION

In one embodiment, the present invention provides a vibratory and/or resonance device integral to the drill string, which includes a drill bit at its bottom end and a bottom hole assembly uphole from the drill bit for performing downhole measurements during the drilling operations. The vibratory device may be operated at any frequency within a predetermined range of frequencies. The resonator is periodically activated at a selected frequency within a range of frequencies to prevent the drill string from getting stuck.

In another embodiment, a vibratory source is placed in a string utilized for cementing a liner in a wellbore. The liner string includes a liner with a liner hanger attached to its uphole end. A liner hanger running tool is removably attached to the liner hanger for positioning the liner hanger in the casing. A vibratory device is attached above the liner hanger running tool, which is then connected to a drill pipe or a tubing to the surface. The liner hanger is positioned in place but is not anchored in the casing. During cementing of the wellbore, the vibratory source may be continuously operated or periodically operated to vibrate the liner to improve cementing of the annulus. The liner hanger is anchored after cementing and the liner hanger running tool is retrieved from the wellbore.

In an alternative embodiment, a vibratory source is installed in the liner at a predetermined location. The source is operated when the cement and mud is pumped into the liner during the cementing operations. After cementing, the source is removed from the liner. The fluid flow through the source is set at the surface before installation in the liner to define the frequency of vibration.

The present invention provides a system for freeing an object stuck in a wellbore. The fishing system contains a fishing tool to be conveyed into the wellbore. The fishing tool contains a device for securely engaging the fishing tool to the stuck object. A resonator induces pulses of mechanical energy at a number of frequencies within a range of frequencies. A sensor associated with the fishing tool detects the response of the object to the pulses of mechanical energy and generates signals representative of such response. A control circuit within the fishing tool determines the optimum operating frequency for the fishing tool from the sensor signals and causes the fishing tool to operate at the operating frequency to free the object.

In one embodiment, a surface control unit controls the operation of the fishing tool in response to the data transmitted by the fishing tool via a suitable telemetry system. In another embodiment, the control circuit within the fishing tool determines the optimum operating frequency and causes the tool to operate at such frequency.

The resonator may be hydraulically operated by a fluid circulating from a source at the surface. or by a fluid present in the wellbore or by an electro-mechanical device, such as a motor or a solenoid or may be a magnetostrictive device. The resonator may produce vibrations radially to the wellbore or along the wellbore axis. Axial vibrations are preferably generated by slugger-type tools. Also, any suitable device may be utilized to engage the resonance tool with the object to be freed. In the case of a stuck drill pipe (object), the resonance fishing tool is, anchored within the drill pipe a certain distance above the stuck point. The resonance is produced in the free length of the drill pipe. In the case of an object that does not have a free pipe section, the resonance fishing tool contains a suitable engagement device at its bottom end and the resonance tool is displaced by an intervening tubular section of a predetermined length, typically about one thousand feet.

The method of freeing an object stuck in a wellbore includes the steps of: (a) conveying a fishing tool in the wellbore, the fishing tool having: a resonator for generating pulses of mechanical energy at a plurality of frequencies within a range of frequencies, a sensor associated with the fishing tool for detecting response of the stuck object to the pulses of mechanical energy and for generating signals representative of the response of the drill pipe, and a control circuit for continually or at least periodically determining the optimum operating frequency for the object from the sensor signals and generating corresponding control signals; and (b) securing the fishing tool at the collar; and (c) operating the resonator at the optimum operating frequency to free the dill pipe.

Examples of the more important features of the invention have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals, wherein.

DETAILED DESCRIPTION OF PREFERRED EMBODIMENTS

The present invention provides apparatus and methods utilizing vibratory and/or a resonance sources for use in performing a suitable operation in wellbores. Such operations include retrieving or freeing an object (fish) stuck in the wellbore, avoiding getting the drill string from getting stuck during the drilling operations, freeing a stuck pipe, aiding in the installation of liners (casings) in the wellbore, and aiding in certain cementing operations downhole. In general, the system of the present invention contains a downhole resonance tool that is latched at a suitable place downhole. The resonance tool includes a pulse generator which generates radial and/or axial pulses of mechanical energy at different frequencies within a range of frequencies in order to vibrate an object. A control circuit, either placed on the surface or within the resonance tool, monitors the response of the object to the induced mechanical pulses and determines therefrom the natural vibration frequency for the object that provides the highest transfer efficiency between the resonance tool and the object (also referred herein as the optimum operating frequency). The resonance tool may operate at discrete frequencies within a range of frequencies or may operate to sweep the frequency range. The system then continues to operate the resonance tool at the operating frequency. During operations, the system continuously monitors and determines the optimum operating frequency, which may change as the object is being freed or dislodged from its position.

Figure 1:
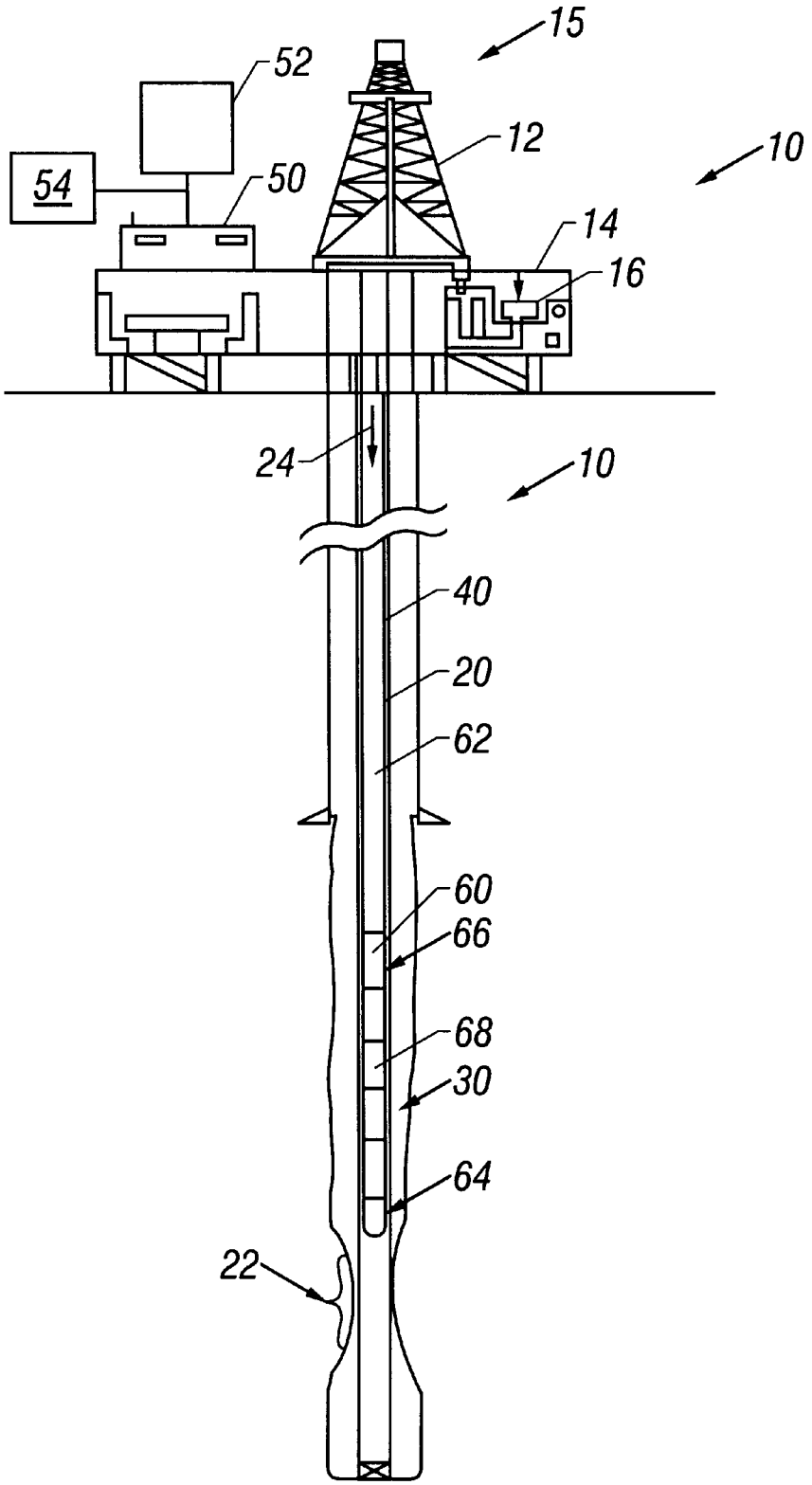
FIG. 1 shows a schematic illustration of a fishing system for freeing and retrieving a drill pipe stuck in a wellbore according to one embodiment of the present invention.
Figure 1A:
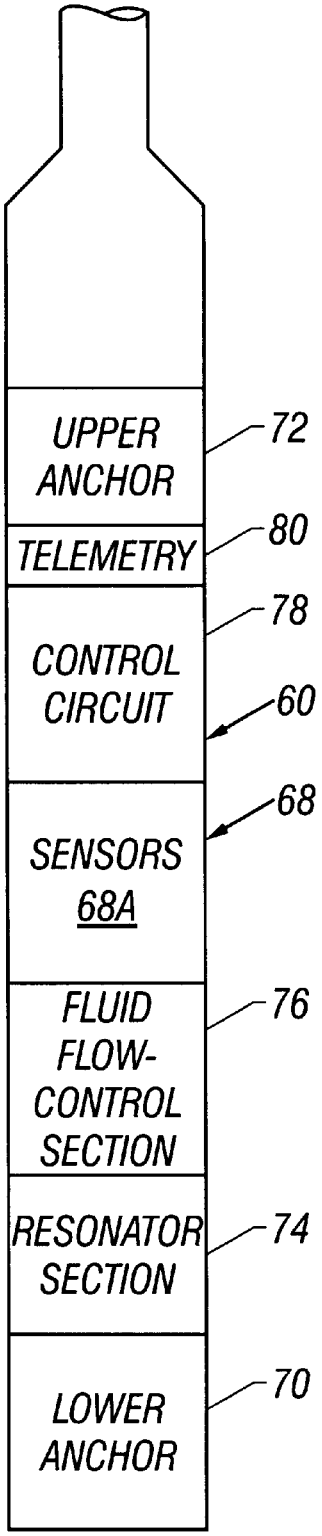
FIG. 1A shows an arrangement of certain functional sections of a downhole resonance tool according to the present invention for use in the system of FIG. 1.
Figure 1B:
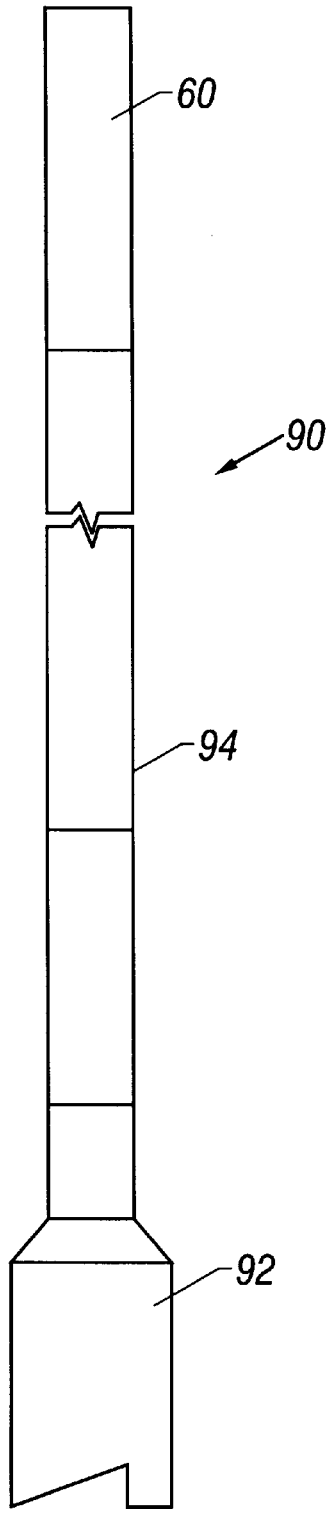
FIG. 1B is an alternative arrangement of certain functional sections of a resonance tool according to the present invention for use in the system of FIG. 1.
Figure 2:
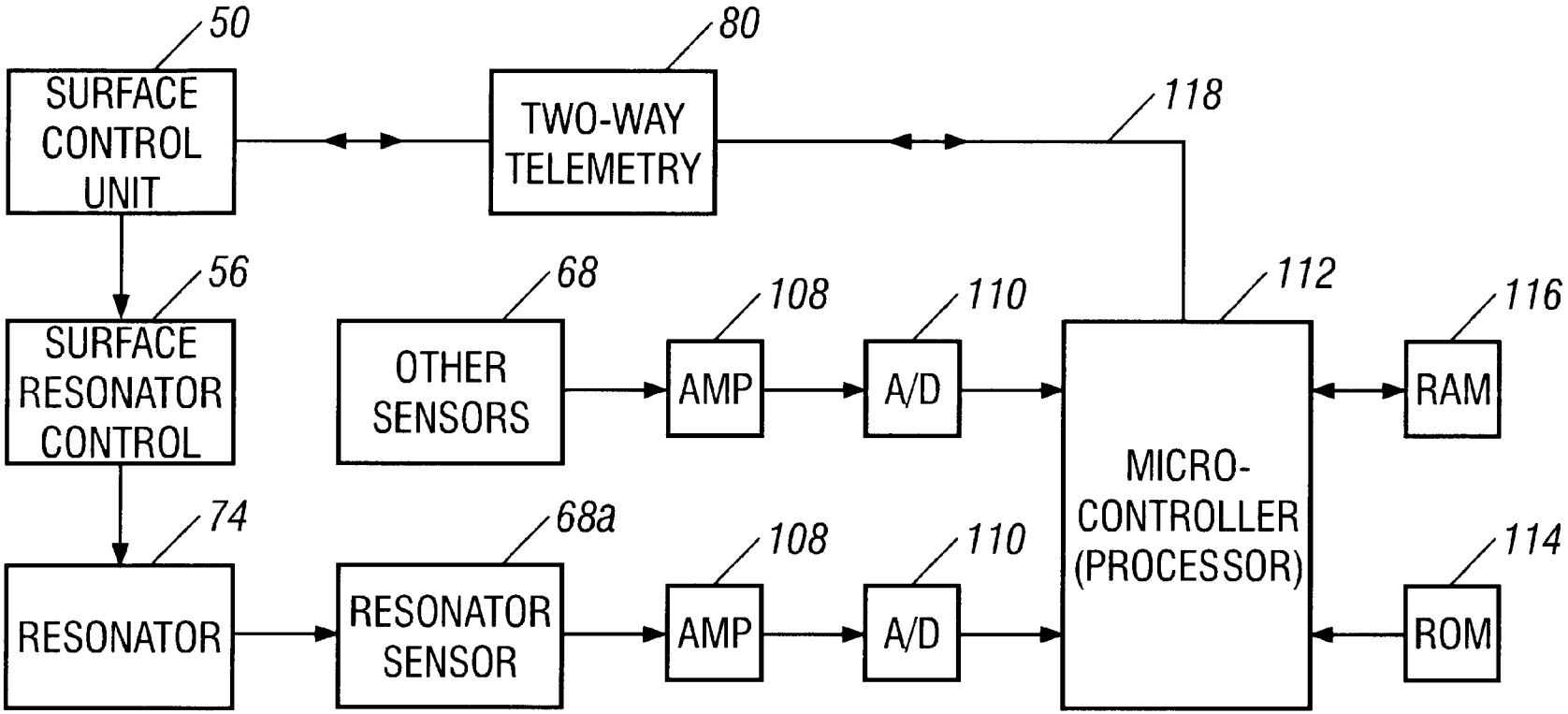
FIG. 2 is a closed-loop block circuit diagram for controlling the operations of the fishing system of FIG. 1.
Figure 3:
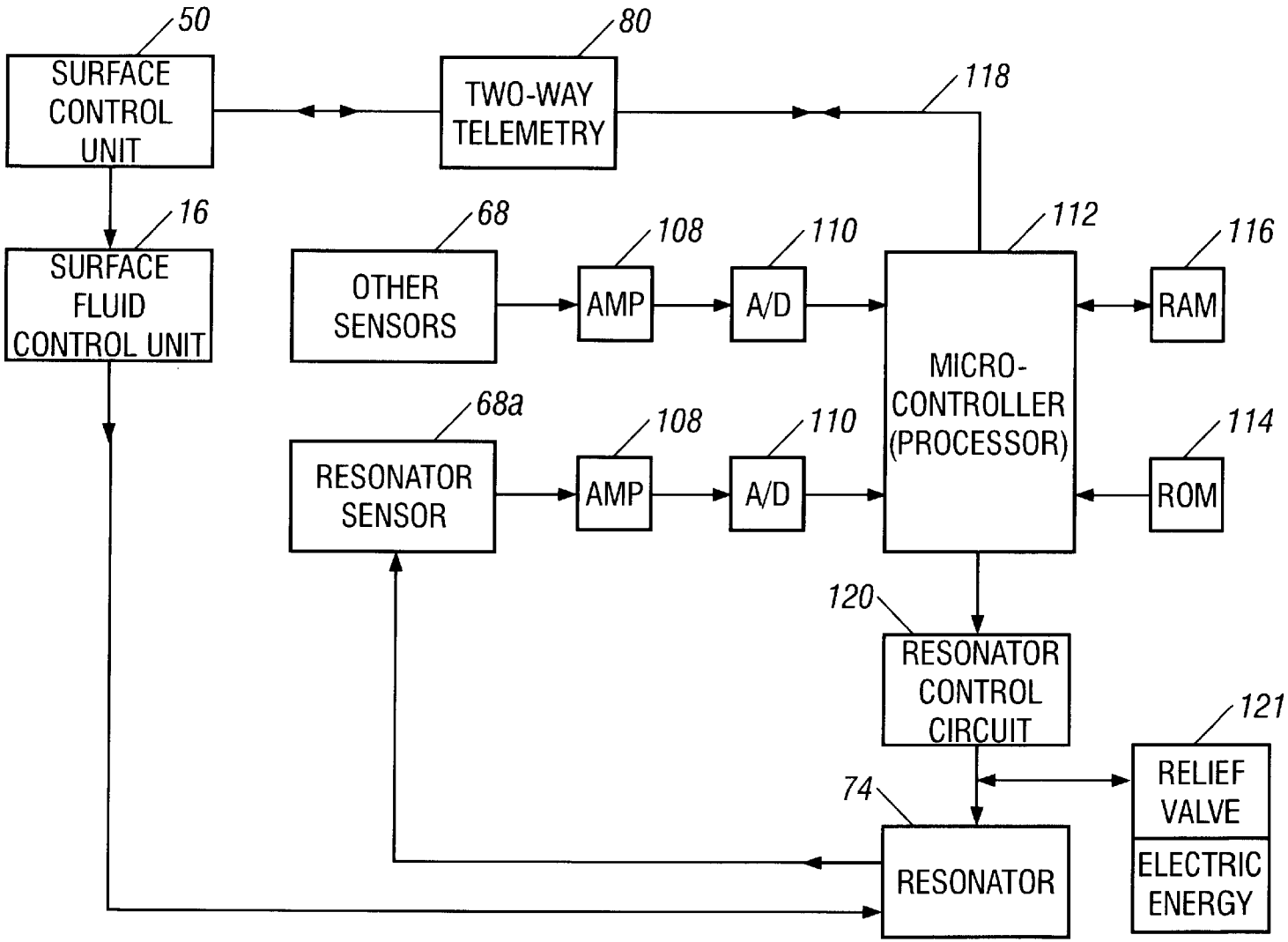
FIG. 3 is an alternative closed-loop block circuit diagram for controlling the operations of the fishing system of FIG. 1.
Figure 5:
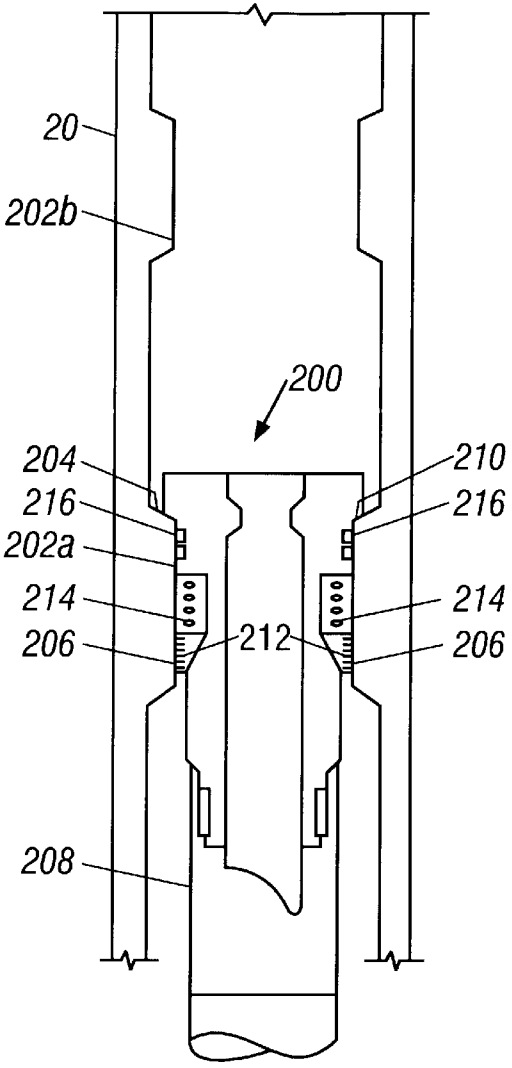
FIG. 5 is a schematic diagram of a device for anchoring the resonance tools in a tubular member.
Figure 4:
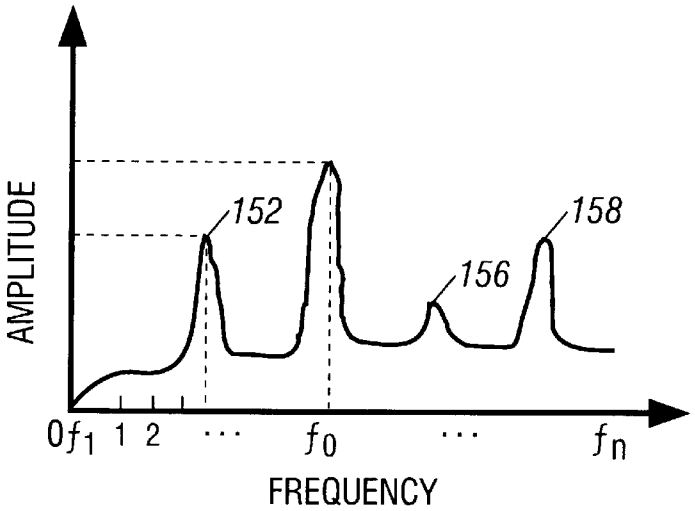
FIG. 4 shows a hypothetical relationship between the amplitude response of the stuck object and the frequency of pulses of mechanical energy generated by a resonance tool.
Figure 6:
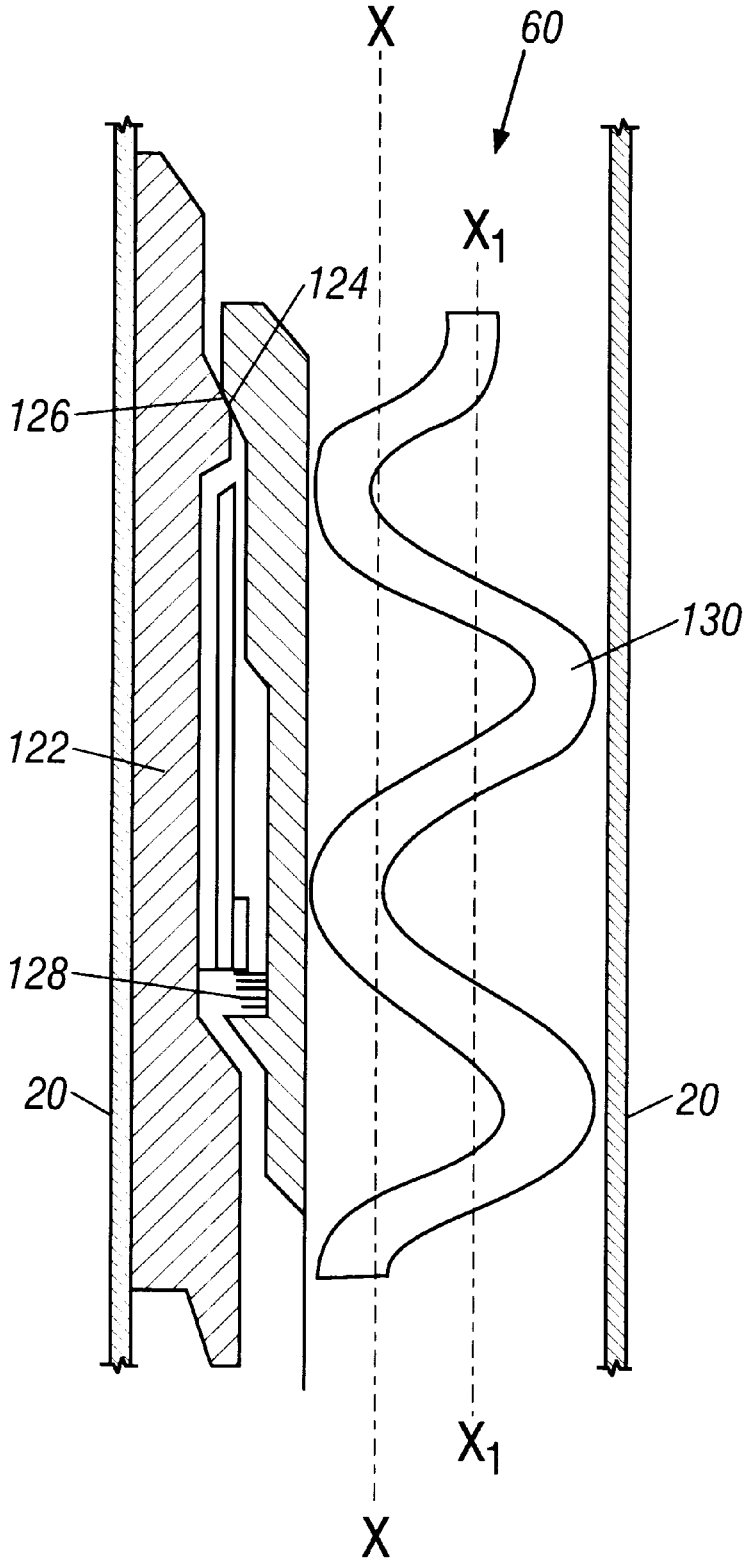
FIG. 6 is a schematic diagram of an alternative device for anchoring the resonance tool in a tubular member.
Figure 7:
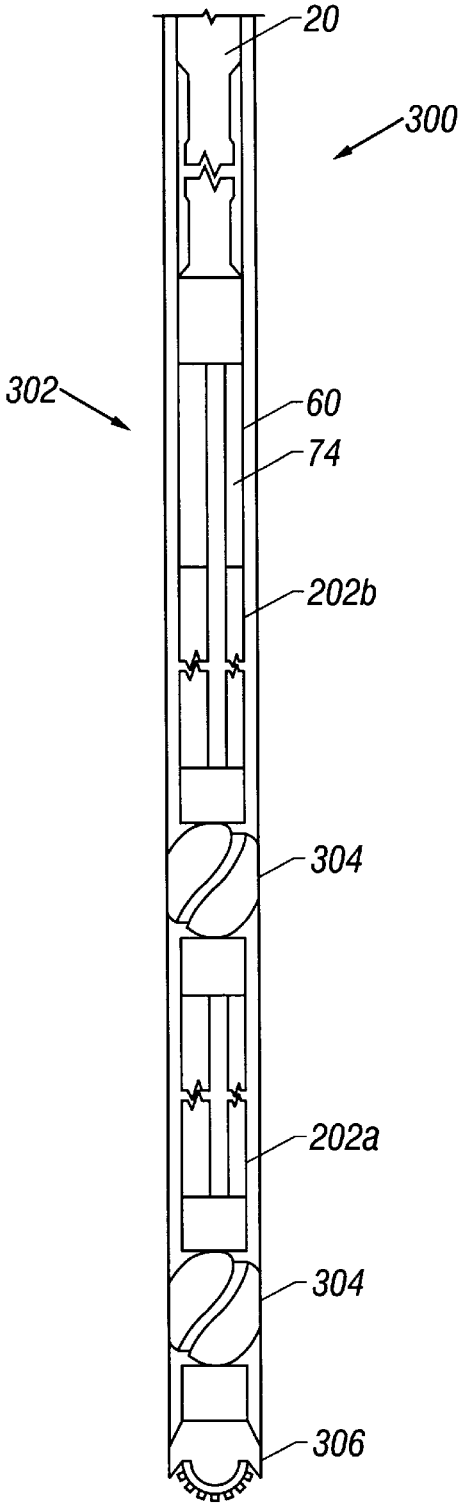
FIG. 7 is a schematic illustration of a drill string with a vibratory source according to one embodiment of the present invention.
Figure 8:
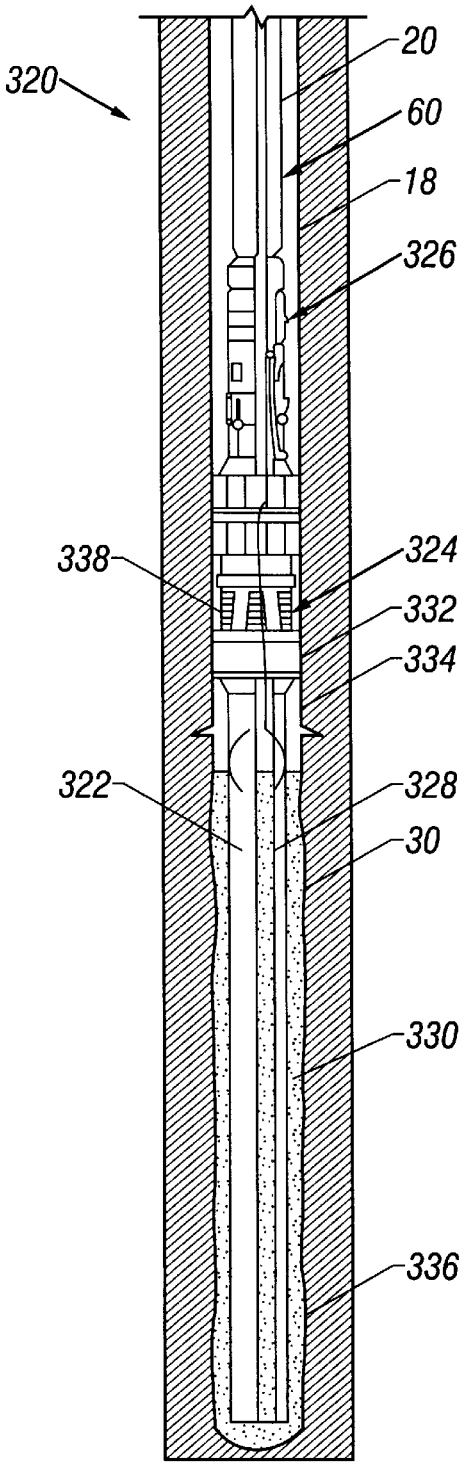
FIG. 8 shows a liner string with a vibratory source during the cementing of a liner in a wellbore with the liner hanger in the open position according to the present invention.

The use of resonance tools according to the present invention is described by way of examples. Accordingly, FIG. 1 shows a system for freeing a stuck drill pipe according to the present invention. FIGS. 1A–1B show examples of embodiments of resonance fishing tool configurations for use in the fishing system of FIG. 1. FIGS. 2–3 show control circuits for in situ determination of the response of the stuck object to a resonator and for controlling the operation of the resonator as a function of the response of the object. FIG. 4 shows a hypothetical relationship between amplitude response of the stuck object and the frequency of pulses of mechanical energy generated by a resonance tool. FIGS. 5–6 show embodiments of latching mechanisms for anchoring the resonance tools to the object to be fished or retrieved. FIG. 7 shows an embodiment of the drill string incorporating a resonance device which can be utilized during the drilling of a wellbore to avoid getting the drill stuck in the wellbore. FIG. 8 shows a manner in which the resonance tool of the present invention may be utilized for cementing a liner (casing) in a wellbore.

FIG. 1 is a schematic diagram of a fishing system 10 for freeing and retrieving a stuck object from within a wellbore 30. As an example and not as a limitation, the system 10 is shown to free a tubular member, such as a drill pipe 20, stuck along a zone 22 in an open hole (wellbore) 30. The fishing system 10 includes a rig (typically a workover rig) 15 that includes a rig mast 12 placed on a drilling platform 14. A fluid control unit 16 pumps a desired fluid 24 into the wellbore 30 via a desired conduit, which depending upon the application may be a coiled tubing 40 or the drill pipe 20.

A surface control unit 50, preferably placed on the platform 14, controls the operation of various surface devices including the fluid control unit 16. The surface control unit 50 communicates with a downhole resonance tool 60 (as described later with reference to FIGS. 2–3) and controls the operation of a variety of surface and downhole devices according to programmed instruction associated with the surface control unit 50. The surface control unit 50 includes one or more computers with associated memory, programmed instructions, power supply and a peripheral interface unit. A monitor or display 52, preferably a touch-type monitor, associated with the control unit 50 displays desired information, such as the values of certain operating parameters. A suitable data entry device, such as a key board (not shown), may be utilized to enter data and instructions to the surface control unit 50. Alarms, generally denoted herein by numeral 54, are activated by the surface control unit 50 when certain warning conditions occur during the operation of the fishing system 10.

Still referring to FIG. 1, the downhole resonance tool 60 is conveyed into the drill pipe 20 by a suitable conveying member such as coiled tubing 40 or a wireline (not shown). To free the drill pipe 20, the resonance tool 60 is anchored at a suitable location 64 at a predetermined distance above the stuck point 22*a*. The resonance tool 60 may be anchored at additional locations, such as location 66 within the drill pipe 20. It is known in the art that drill pipes 20 and other objects have a resonance frequency and harmonics thereof that are a function of the length of the free portion of the drill pipe 20 between the stuck point 22*a* and the anchor point 64. Locating the anchor point 64 at a distance between five hundred feet to one thousand feet is deemed sufficient to create desired resonance in the drill pipe 20.

FIG. 1A shows an arrangement of certain major functional components of the resonance tool 60. The resonance tool 60 includes a latching device or a lower anchor 70 at its lower end and may contain a secondary upper anchor 72 at its upper end. A pulser or resonator 74 disposed above the lower anchor 70, which can operate at any frequency within a predetermined range of frequencies. Any suitable resonator 74 may be utilized for the purpose of this invention. One such resonator 74 is disclosed in U.S. Pat. No. 4,815,328 issued to Bodine, which is assigned to the assignee of this application and which is incorporated herein be reference. This patent discloses a roller-type orbiting mass oscillator that generates pulses of mechanical energy in the radial direction, i.e., orthogonal to the longitudinal axis of the drill pipe 20, when a fluid is passed through this device.

Another resonator 74 is disclosed in the U.S. Pat. No. 4,824,258, issued to EBodine and assigned to the assignee of this application and which is incorporated herein by reference. The U.S. Pat. No. 4,824,258 discloses a fluid driven screw type (Moyno) sonic oscillator for generating radial pulses of mechanical energy. Alternatively, the present invention may utilize devices that impart axial pulses of mechanical energy, i.e., along the longitudinal axis of the drill pipe 20. A fluid-driven device that imparts axial vibrations is commercially available from Gefro Oilfield Services a/s of Norway under the trade name "Zeta Tools." The pulse rate (frequency) of the above-noted devices is controlled by controlling the fluid flow through these devices.

If a fluid-driven resonator 74 is utilized, the fluid flow may be controlled at the surface through the fluid control unit 16 (see FIG. 1). In the present invention, the flow of the fluid 24 is controlled by the surface control unit 50, as more fully explained later. Alternatively, the fluid flow through resonators 74 may be controlled downhole by the fluid flow control section 76, such as by directing only the desired amount of fluid 24 through the resonator 74. This may be done by controllably diverting a portion of the fluid 24 away from the resonator 74, such as by diverting the fluid 24 into the drill pipe 20 or the wellbore 30 via a control valve (not shown) placed in the fluid path between the fluid source and the resonator 74. Any suitable flow control device may be placed in the fluid control section 76 to control the flow of the fluid through the resonator 74. Such flow control devices are selectively opened and closed to direct the desired amount of fluid through the resonator 74. The resonance tool 60 preferably contains a plurality of sensors 68, with at least one such sensor (a resonator sensor) 68*a* for determining the response of the object or the drill pipe 20 to the pulses of mechanical energy generated by the resonator 74. An accelerator (not shown) suitably placed in the tool 60 may be utilized as a sensor 68*a* for detecting the response of the drill pipe 20 to the resonator pulses. Alternatively, a plurality of sensors 68 suitably placed in the tool 60 may be utilized for determining the response of the drill pipe 20 to the resonator 74 pulses.

Still referring to FIG. 1A, the resonance tool 60 further includes a downhole control circuit or unit 78 for continuously monitoring the response of the drill pipe 20 to the resonator 74 pulses and for controlling the operation of the resonance tool 60 as a function of such response according to programmed instruction provided to the downhole control circuit 78. Other sensors 68 such as a pressure sensor, temperature sensor and a fluid flow rate sensor may also be placed in the tool for determining various downhole operating parameters. A two-way telemetry 80 is included in the resonance tool 60 for communicating data and command signals between the downhole control circuit 78 and the surface control unit 50.

FIG. 1B shows a schematic diagram of an alternative arrangement of the resonance tool 60 configured in a string 90. The string 90 contains the resonance tool 60 at the upper end of a drill pipe 94 and an engaging device 92 at the bottom end of the drill pipe 94. The engaging device 92 is designed to latch onto a stuck object (not shown) in the wellbore. The engaging device 92 may be any known engaging device in the art. The engaging device 92 may engage or grab the stuck object at an outer surface or at an inner surface of the stuck object. The engaging device 92 may include a plurality of gripping members (not shown) which may be independently controlled to move outwardly and inwardly about the tool body. Various types of engaging devices 92 are known in the art and, therefore, are not described in detail herein.

The resonance tools 60 of the present invention may include a device (not shown) for determining the location of the stuck object, particularly a device for determining the free point of a stuck pipe in a wellbore. Resonance tools 60 having such devices for determining the free point are useful in that the resonance tool 60 may be conveyed first to determine the free point and then anchored at a desired distance above the free point. The resonance tool 60 so used determines the free point and frees the stuck object in a single trip compared to two trips that will be required if such devices are not integrated into the resonance tool 60.

As noted earlier in FIG. 1, the operation of the fishing system 10, including the operation of the resonance tool 60 may be controlled by the surface control unit 50 or by the downhole control circuit 78 associated with the resonance tool 60 or a combination of the two. For simplicity, numeral 60 is used hereinafter to mean any resonance tool utilized for the purpose of this invention. The operation of the resonance tool 60 controlled by the surface control unit 50 will be described first while referring to FIGS. 1, 1A, 1B, 2 and 4. The operation of the resonance tool 60 controlled by the downhole control circuit 78 will be described thereafter while referring to FIGS. 1, 1A, 1B, 3 and 4.

Now referring to FIGS. 1, 1A, 1B, 2 and 4, to free an object (not shown) stuck in the wellbore 30, the resonance tool 60 is conveyed into the wellbore 30 by any suitable method or device, such as by a wireline, a coiled tubing 40 having a conductor therein or by pumping the resonance tool 60 down into the wellbore 30 with a fluid 24. In the case of a stuck pipe, the resonance tool 60 is preferably conveyed into the drill pipe 20 via the coiled tubing 40 and anchored at a predetermined location 64 above the stuck point 22*a*. In the case of a stuck object engaging member 92 is securely engaged or attached to the stuck object.

Referring to FIG. 2, once the resonance tool 60 has been properly engaged with the object to be retrieved, the surface control unit 50 operates the fluid control unit 16, i.e., pumps the fluid 24 downhole at an initial flow rate $F_{L1}$. This fluid causes the resonator 74 to generate pulses of mechanical energy at an initial rate or frequency $f_1$, which causes the stuck object to vibrate. The resonator sensor 68*a* detect the response of the object to the induced pulses of mechanical energy and generates signals that correspond to the amplitude of the response of the object. The sensor signals are amplified by an amplifier 108, converted into digital signals by an analog-to-digital converter (A/D) 110 and fed to a micro-controller 112. The micro-controller 112 may be a general purpose processor, such as a microprocessor, digital signal processor (DSP) or any other device that can process the required signals and data from the tool 60. The micro-controller 112 processes the received sensor signals to determine the amplitude of the response of the object to the induced pulses or vibrations and further processes such data according to stored instructions (programs) in an associated read only memory ("ROM") 114. The micro-controller 112 stores the computed information in a downhole memory 116, which may be a random-access-memory ("RAM") and transmits such data (information) to the surface control unit 50 via the two-way telemetry 80 over a data bus 118. The surface control unit 50 then changes the fluid flow rate (and thus the corresponding fluid pressure) by a predetermined value to $F_{L2}$, which in turn causes the resonator 74 to vibrate at a corresponding frequency $f_2$. The surface control unit 50 determines the response of the object at this frequency. This procedure is repeated to sweep the desired frequency range to determine the optimum or effective operating frequency.

A hypothetical amplitude versus frequency response of the object is shown in FIG. 4. The local amplitude maxima are shown to occur at points 152, 154, 156 and 158, with the maximum amplitude response occurring at point 154 and a frequency $f_O$. The surface control unit 50, alone or in cooperation with the micro-controller 112, adjusts the fluid flow rate to continue to operate the resonator 74 at the operating frequency $f_o$ until the object is freed. If the effective operating frequency shifts during the operation, the surface control unit 50 can be programmed to continually or periodically adjust the fluid flow rate so as to operate the resonator 74 at the desired frequency. The above-described operations may be performed by an operator controlling the frequency changes or automatically by the downhole micro-controller 112 and/or the surface control unit 50.

In the case of a stuck drill pipe 20, once the drill pipe 20 is free, the resonance tool 60 is detached and retrieved back to the surface. The drilling operation is then be continued or the drill pipe 20 is retrieved to either change the drill pipe 20 and/or to perform some remedial work in the wellbore 30 to prevent the stuck conditions from recurring. In the case of objects to be retrieved to the surface, the resonance tool 60 is retrieved along with the freed object.

As noted earlier, the resonator 74 may be a non-fluid operated resonator 74, such as solenoid operated or electro-mechanically operated. In such a case, the surface control unit 50 controls the electrical operation of such devices to operate the resonators 74 at the selected frequencies. Alternatively, the resonator 74 may utilize a magnetostrictive device, wherein electrical energy is alternately applied and released in a metal member (not shown) to create acoustic pulses. The frequency of operation is controlled by varying the rate at which the application of the electrical energy is switched. The resonator 74 may also utilize a piezoelectric device (not shown) or any other device that can generate sufficient energy to vibrate the stuck device.

FIG. 3 is a functional block diagram of a control system which may be utilized to control the operation of the resonance tool 60 downhole, i.e., by the micro-controller 112. In this system, the micro-controller 112 controls the fluid flow through the resonator 74 (for a fluid-type resonator) or the electrical energy to the resonator (for an electrically operated resonator), as the case may be, via a resonator control circuit 120. In one embodiment, the resonator circuit 120 is employed to control a relief valve 121 associated with the resonance tool 60 in a fluid-operated resonator 74 or the electrical energy supplied to an actuator in an electrically-operated resonator 74, such as solenoid or motor. The micro-controller 112 also transmits information to the surface control unit 50. The surface control unit 50 may be programmed to override operations of the downhole micro-controller 112. Alternatively, an operator may input instructions to the surface control unit 50 and control the operation of the system 10 including the downhole resonance tool 60.

As noted above in reference to FIG. 1A, in each of the above-described systems, other desired sensors 68 are also deployed in the resonance tools 60. The signals from such sensors 68 are amplified and converted by corresponding amplifiers 108 and A/D converters 112 before being processed by the micro-controller 112 according to programmed instructions.

FIG. 5 shows a latching device 200 and method for engaging such a latching device 200 to a tubular member, such as drill pipe 20. During the drilling operations, one or more landing collars 202, such as lower and upper collars 202*a* and 202*b*, respectively, are installed in the drill pipe 60, where they are spaced at a selected distance. Two to three such collars 202 are deemed sufficient for many drilling operations. The spacing between the adjacent collars 202 is preferably between five hundred feet to two thousand feet. The internal diameter of the successive collars 202 starting from the lower collar 202*a* is successively made smaller. As shown in FIG. 5, the internal diameter of the lower collar 202*a* is less than the internal diameter of the upper collar 202*b*. In this manner, a latching device 200 of suitable external dimensions can be placed at any desired collar 202.

In FIG. 5, the latching device or anchor 200 is shown engaged with the lower collar 202*a*. The lower collar 202*a* has a landing 204 at its upper end and an internally-threaded section 206 along its internal diameter. The latching device 200 contains a body 208 having outside dimensions that enable the latching device 200 to pass through each of the collars 200 that precede (are uphole from) the lower collar 202*a*. The latching device 200 contains a flange 210 that is designed to rest or seat on the landing 204. The latching device 200 also has threads 212 along its outer surface. These threads 212 are designed to engage the internally-threaded section 206 of the collar 202*a*. The latching device 200 also includes a spring 214 above the threads of the internally-threaded section 206 and a plurality of seals 216 between the spring 214 and the flange 210.

To engage the latching device 200 with the collar 202*a* and, therefore, the drill pipe 20, the latching device 200 is conveyed into the drill pipe 60 by a suitable conveying member 40, such as coiled tubing, wireline or by pumping it downhole by a fluid. Because the outer dimensions of the latching device 200 are smaller than the inside dimensions of any of the collars 202 located above the lower collar 202*a*, the latching device 200 will pass all such collars 202 when conveyed downhole. When the latching device 200 reaches the lower collar 202*a*, the latching device 200 is securely engaged with the lower collar 202*a* by engaging the threads 212 with the threads of the internally-threaded section 206. The spring 214 provides resiliency to the connections and the seals 216 prevent leakage of fluids around the latching device 200. The resonance tool 60 may be attached at the bottom end of the latching device 200, as shown in FIG. 5 or above (not shown) the latching device 200. The resonance tool 60 is retrieved from the wellbore 30 by disengaging the latching device 200 from the lower collar 202*a*.

FIG. 6 shows another embodiment of a latching mechanism for anchoring the resonance tool 60 in a tubular member 20 such as the drill pipe. A carrier 122 is anchored at a suitable location in the drill pipe 20. The carrier 122 has an inner landing support 124. To anchor the resonance tool 60 to the tubular member 20, the resonance tool 60 is conveyed into the tubular member 20. The resonance tool 60 has a seat 126 that is designed to rest on the inner landing support 124. The resonance tool 60 also has an outside threaded portion 128 that is screwed into the carrier 122. The resonator 74 shown is a Moyno-type resonator, which includes a rotor 130 whose longitudinal axis $x_1$—$x_1$ is parallel but offset to the longitudinal axis x—x of the resonance tool 60. The rotor 130, when rotated about the axis $x_1$—$x_1$, generates radial (orthogonal to the longitudinal axis x—x) pulses of mechanical energy in the tubular member 20. The rotor 130 may be rotated by passing a fluid under pressure along the longitudinal axis, or by an elector-mechanical device, such as a motor (not shown). The operation of the resonator 74 is controlled in the manner described above with reference to the resonator 74 of FIG. 1.

Alternatively, any commercially available anchor may be utilized for the purpose of this invention. Some such devices are referred to in the oil and gas industry as the liner hangers. A wide variety of liner hangers are sold by a number of manufacturers, including the assignee of this application. Additionally, any commercially available engagement device may be utilized for applications where the resonance tool is used to engage with any other object stuck in the wellbore. A variety of engagement devices are currently available for engaging fishing tools with the objects to be retrieved.

FIG. 7 is a schematic illustration of a drill string 300 with a vibratory source (resonance tool) 60 attached to a suitable conveying member, such as drill pipe 20, at an upper end and to the upper collar 202*b* at a lower end. The upper collar 202*b* is then connected to a bottom hole assembly (BHA) 302, which preferably includes a plurality of stabilizers 304 connected via the lower collar 202*a* to a drill bit 306, to complete the drill string 300.

In a typical drilling operation, the drill bit 306 sometimes becomes stuck due to such factors as the weight-on-bit (weight of uphole equipment and drill pipe 20 on the drill bit 306), the rotary speed of the drill bit 306 and/or the fluid flow rate. With the preferred embodiment of the present invention, a signal can be communicated to the resonance tool 60 to start an operation to free the drill bit 306. As described above, the resonator 74 (FIG. 1) contained within the resonance tool 60 is activated and a sweep of frequencies is performed to determine an optimum or effective frequency.

During drilling operations, the vibratory device (resonator) 74 is operated at a predetermined frequency or at several frequencies to determine the effective frequency. During normal drilling, the vibratory source 74 may be periodically operated for a predetermined time period. Typically, the resonator 74 is operated during the times when a drill pipe section is added to the drill string, which usually occurs after the drilling of every 30 or 40 feet. The vibratory source 74 may be fluid operated, such as by the drilling fluid 24, or may be an electrically operated device, such as a magnetostrictive device. The vibratory source 74 may be operated independently of any other device in the drill string. For fluid operated vibratory source, valves associated with the source control the fluid flow through the source, thereby controlling the operating frequency of the source. The source may be operated to sweep the frequency range to determine the most effective frequency and then operated at such frequency.

Resonator sensors 68*a* (FIG. 3) transmit signals to either the surface control unit 50 or the downhole micro-controller 212 and the frequency is then selected. The resonator 74 is operated at the determined frequency, as described above, until the drill bit 306 is freed and drilling operations can be continued. By having the resonance tool 60 downhole as an integral part of the drill string 300, lost time due to a stuck drill bit 306 can be minimized.

The use of the resonance devices for cementing operations will now be described while referring to FIG. 8, which shows, by way of an example, a liner string 320 disposed in the wellbore 30 during a cementing of a liner 322. The liner string 320 is shown to include the liner 322, a liner hanger 324, a liner hanger running tool 326 and the vibratory source (resonance tool) 60. The liner string 320 is detachably connected to a conveying member, such as drill pipe 20. The liner string 320 is run downhole until the liner hanger 324 is positioned at a desired location in the wellbore 30.

In prior art operations (not shown), the liner hanger 324 is typically first anchored in the casing 18. The cement 330 is then circulated through the annulus between the liner 322 and the wellbore 30. The liner 322 is sometimes jarred or rotated to obtain more effective cementing in the annulus.

In this preferred embodiment of the present invention, however, the liner hanger 324 is not anchored prior to cementing. Cement 330 is pumped downhole through tubing 328 and flows from the bottom of the liner 322 and up the annulus located between the liner 322 and the wall of the wellbore 30. In one preferred embodiment, the resonance tool 60 is activated during the cementing process. In another embodiment, the resonance tool 60 is activated after circulating a predetermined volume of the cement 330 in the annulus. If a fluid-operated source is utilized, the slurry of cement 330 used for cementing the annulus may be used to operate the vibrating source (resonator) 74. Alternatively, after circulating a predetermined volume of the cement 330 in the annulus, the resonator 74 may be sealed from the liner hanger 324 by closing a valve (not shown) between the liner hanger 324 and the resonator 74. The resonator 74 is then operated at an effective frequency within a predetermined range of frequencies to vibrate the liner 322, which shakes the cement 330 in the annulus and causes voids and channels in the annulus to be filled with the cement 330.

The resonator 74 generates pulses of mechanical energy which cause the liner 322 and the cement 330 to vibrate. These vibrations cause the cement 330 in the annulus to shift and causes voids and channels in the annulus to be filled with the cement 330. Once the cementing operation is completed, the liner hanger 324 is anchored via anchors 338, the liner hanger running tool 326 is detached from the liner hanger 324 and is retrieved with the resonance tool 60 back to the surface.

In a similar method involving cementing operations in the wellbore 30, a vibrating source 74 is integrated into a running tool string and is activated at a determined frequency, after sweeping the frequencies as described above, during the cementing operation. One such operation is the sealing of a juncture (not shown) with cement 330. The vibrations cause the cement 330 around the juncture to shift such that voids and channels will fill with cement 330 as described above.

Thus, the present invention provides apparatus and method for use of resonance or vibratory devices for performing an operation downhole. The resonance device may be any suitable device and may include a lateral force generator, an axial force generator, a mechanical force generator, a solenoid-operated force generator, an electro-mechanical device, an inductive device a fluid-operated device and a magnetostrictive device. The resonator is suitably placed in the wellbore and operated at an effective frequency selected from a range of frequencies. A sensor associated with the resonator is utilized to detect the response of an object in the wellbore, which is utilized to adjust or alter the operating frequency of the resonator. The object in the wellbore may be a fish, a stuck tubing, a drill string, a liner, and a member associated with performing a cementing operation in the wellbore or any other suitable element while the selected operation may include fishing, freeing a stuck drill string, freeing a stuck tubular, installing a liner, cementing a juncture, a general cementing operation, and drilling of a wellbore.

While the foregoing disclosure is directed to the preferred embodiments of the invention, various modifications will be apparent to those skilled in the art. It is intended that all variations within the scope and spirit of the appended claims be embraced by the foregoing disclosure.

What is claimed is:

1. A downhole resonance tool for performing a desired operation in a preexisting wellbore, comprising:

(a) an engagement device for engaging the resonance tool to an object in the wellbore;

(b) a resonator for inducing pulses of energy in the object at frequencies within a range of frequencies; and (c) a sensor associated with the downhole resonance tool for detecting response of the object to the induced pulses of energy and providing signals representative of said response of the object for determining an operating frequency for the resonator.

2. The downhole resonance tool according to claim 1, wherein the resonator is selected from a group consisting of a lateral force generator, an axial force generator, a mechanical force generator, a solenoid-operated force generator, an electro-mechanical device, an inductive device, a fluid-operated device, an acoustic device and a magnetostrictive device.

3. The downhole resonance tool according to claim 1, wherein the object in the wellbore is one of a fish, a tubing, a drill string, a liner, and a member associated with performing a cementing operation in the wellbore.

4. The downhole resonance tool according to claim 1, wherein the desired operation is selected from a group consisting of fishing, freeing a stuck drill string, freeing a stuck tubular, installing a liner, cementing a juncture, a cementing operation, a workover operation, a completion operation, and a drilling operation.

5. The downhole resonance tool according to claim 1, wherein the engagement device engages the object on an outside surface of the object.

6. The downhole resonance tool according to claim 1, wherein the engagement device engages the object on an inside surface of the object.

7. The downhole resonance tool according to claim 1, wherein the object is a tubular member and wherein the downhole tool further comprises a landing member for engagement with the tubular member.

8. The downhole resonance tool according to claim 1 further comprising a controller associated with the downhole resonance tool for determining the operating frequency of the resonator.

9. The downhole resonance tool according to claim 8, wherein the controller is located at one of (i) at least partially in the resonator, and (ii) at the surface.

10. The downhole resonance tool according to claim 8, wherein the controller operates the resonator at the operating frequency.

11. The downhole resonance tool according to claim 10, wherein the operating frequency is resonance frequency of the object attached to the downhole resonance tool.

12. The resonance tool of claim 8 wherein the controller at least periodically determines the resonance frequency and operates the resonator at said resonance frequency.

13. A method of performing a desired operation in a wellbore, comprising:

conveying a resonance tool adapted to induce pulses of energy in an object located in the wellbore and engaged with the resonance tool, said resonance tool having a sensor associated therewith for detecting response of the object to the induced pulses of energy and providing signals representative of said response of the object;

engaging the resonance tool with the object in the wellbore;

inducing pulses of energy in the object at frequencies within a range of frequencies;

detecting response of the object with the sensor to the induced pulses of energy and determining therefrom an operating frequency; and inducing pulses of the energy at the operating frequency to perform the desired operation.

14. The method according to claim 13, wherein the operating frequency is a resonance frequency.

15. The method according to claim 13, further comprising adjusting the operating frequency if the response of the object is out of resonance.

16. The method according to claim 13 further comprising selecting the desired operation from one of fishing, freeing a stuck drill string, freeing a stuck tubular, installing a liner, cementing a juncture, a cementing operation, a workover operation, a completion operation, and drilling of a wellbore.

17. The method according to claim 13, wherein the object in the wellbore is one of a fish, a tubing, a drill string, a liner, and a member associated with performing a cementing operation in the wellbore.

18. The method according to claim 13 further comprising at least periodically altering the frequency of the induced pulses of energy to determine the operating frequency.

19. A drill string for use in drilling a wellbore, comprising:

(a) a drill bit at the downhole end of the drill string;

(b) a bottom hole assembly uphole of the drill bit having a first sensor for determining a parameter of interest associated with the wellbore; and (c) a resonator attached to the drill string uphole of the drill bit, said resonator operable at frequencies within a predetermined range of frequencies, said resonator inducing pulses of energy when operated at said frequencies; and (d) a second sensor providing signals corresponding to response of the drill string to the induced pulses of energy for determining an operating frequency for the resonator.

20. The drill string according to claim 19, further comprising a controller for determining the operating frequency of the resonator and controlling the operation of the resonator at the operating frequency.

21. The drill string according to claim 20, wherein the controller is placed at a surface location or at least partially in the drill string.

22. The drill string according to claim 19, further comprising a tubular member that has a traction device having a wellbore hanger adjacent an upper end of the tubular member for selectively securing the traction device in the wellbore, said traction device generating a traction force for retrieving the object form the wellbore.

23. A method of freeing a pipe stuck at a stuck point in a wellbore, comprising:

(a) determining the stuck point by a wireline tool conveyed in the pipe, said wireline tool determining the location of the stuck point from response of the pipe to acoustic signals transmitted by the wireline tool within the pipe;

(b) conveying a string in the pipe, said string having a vibratory device for generating pulses of mechanical energy at a predetermined frequency within a range of frequencies, a sensor for detecting response of the pipe to the pulses of mechanical energy and for generating signals representative of the response of the pipe, and a control circuit for determining an operating frequency for the pipe from the sensor signals;

(c) securing the string to the pipe at a predetermined distance above the stuck point;

(d) operating the vibratory device at a plurality of frequencies within the range of frequencies;

(e) determining the operating frequency from the response of the pipe to the plurality of frequencies; and (f) operating the vibratory device at the operating frequency to free the pipe.

24. The method according to claim 23 further comprising locating the controller at one of (i) a surface location, and (ii) at least in part in the wellbore.

25. The method according to claim 23, wherein the sensor signals are transmitted to the controller and wherein said controller determines the operating frequency and operates the vibratory device at the operating frequency.

26. A method of freeing an object located in a wellbore, comprising:

(a) determining the location of the object within the wellbore;

(b) securing a string to the object, said string having, a vibratory device for generating pulses of mechanical energy at a predetermined frequency within a range of frequencies, a sensor for detecting response of the object to the pulses of mechanical energy and for generating signals representative of the response of the object, and a control circuit for determining an operating frequency for the object from the sensor signals;

(c) operating the vibratory device at a plurality of frequencies within the range of frequencies;

(d) selecting an operating frequency from the response of the object to the plurality of frequencies; and (e) operating the vibratory device at the operating frequency to free the object.

27. The method of claim 26, wherein the operating frequency is the resonance frequency of the object attached to the string.

28. The method according to claim 26 further comprising selecting the object from a group consisting of a fish, a tubing, a drill string, a liner, and a member associated with performing a cementing operation in the wellbore.

29. The method according to claim 26 further comprising retrieving the freed object from the wellbore.

30. A method of freeing a drill pipe stuck at a stuck point in a wellbore, said drill pipe having a landing collar inside the drill pipe above the stuck point, said method comprising:

(a) conveying a string in the drill pipe, said string having, (i) a vibratory device for generating pulses of mechanical energy at a predetermined frequency within a range of frequencies, (ii) a sensor associated with the string for detecting response of the drill pipe to the pulses of mechanical energy and for generating signals representative of the response of the drill pipe, and (iii) a control circuit for determining an operating frequency for the drill pipe from the sensor signals and generating corresponding control signals;

(b) securing the drill string at the collar;

(c) operating the vibratory device by sweeping the frequency of operation within the range of frequencies;

(d) determining the response of the drill pipe to the vibratory device frequencies;

(e) selecting the operating frequency for operating the vibratory device; and (f) operating the vibratory device at the operating frequency to free the dill pipe.

31. The method of claim 30, further comprising:

(i) continually monitoring the response of the drill pipe to the vibratory device;

(ii) continually determining the operating frequency of the vibratory device; and (iii) continually controlling the operation of the vibratory device so as to continually operate the vibratory device at the operating frequency.

* * * * *